US010378779B2

(12) United States Patent
Park et al.

(10) Patent No.: US 10,378,779 B2
(45) Date of Patent: Aug. 13, 2019

(54) GAS FURNACE FOR INDOOR HEATING

(71) Applicant: LG ELECTRONICS INC., Seoul (KR)

(72) Inventors: Janghee Park, Seoul (KR); Yongki Jeong, Seoul (KR); Baikyoung Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 448 days.

(21) Appl. No.: 15/093,550

(22) Filed: Apr. 7, 2016

(65) Prior Publication Data

US 2017/0176023 A1 Jun. 22, 2017

(30) Foreign Application Priority Data

Dec. 22, 2015 (KR) ..... 10-2015-0183894

(51) Int. Cl.
*F24D 5/04* (2006.01)
*F24D 19/10* (2006.01)
*F24H 3/08* (2006.01)

(52) U.S. Cl.
CPC ..... *F24D 19/1084* (2013.01); *F24D 5/04* (2013.01); *F24H 3/087* (2013.01)

(58) Field of Classification Search
CPC ..... F24D 19/1084; F24D 5/04; F24H 3/087
See application file for complete search history.

(56) References Cited

U.S. PATENT DOCUMENTS

2011/0271880 A1* 11/2011 Thompson ..... F23N 5/184 110/186

FOREIGN PATENT DOCUMENTS

| | | | |
|---|---|---|---|
| JP | 7-245931 | A | 9/1995 |
| JP | 8-296758 | A | 11/1996 |
| JP | 2003-336753 | A | 11/2003 |
| JP | 2011-144848 | A | 7/2011 |
| KR | 10-1992-0016794 | A | 9/1992 |
| KR | 10-2002-0013274 | A | 2/2002 |

* cited by examiner

*Primary Examiner* — Alfred Basichas
(74) *Attorney, Agent, or Firm* — Dentons US LLP

(57) ABSTRACT

Disclosed is a gas furnace for indoor heating. The gas furnace includes a burner to generate high-temperature exhaust gas, an exhaust flow path, a blower to suction indoor air through a recovery flow path, a supply flow path to guide the indoor air to the indoor space after undergoing heat exchange in the exhaust flow path, and a fuel supply unit including a fuel supply line and a fuel discharge line, configured to supply fuel to the burner, and a valve between the fuel supply line and the fuel discharge line. The valve includes a step motor, and a blocking member coupled to a rotating shaft of the step motor and configured to move straight via by driving of the step motor, and an opening degree of the valve between the fuel supply line and the fuel discharge line is adjusted by the straight movement of the blocking member.

17 Claims, 6 Drawing Sheets

GAS FURNACE FOR INDOOR HEATING

CROSS-REFERENCE TO RELATED APPLICATION

This application claims the benefit of Korean Patent Application No. 10-2015-0183894, filed on Dec. 22, 2015, the disclosure of which is incorporated herein by reference.

BACKGROUND OF THE INVENTION

1. Field of the Invention

The present disclosure relates to a gas furnace for indoor heating, which is configured to heat an indoor space by supplying warm air into the indoor space via heat exchange between air and hot exhaust gas generated by the burning of fuel. More particularly, the present disclosure relates to a gas furnace for indoor heating, which includes a single valve capable of controlling heating power in multiple stages.

2. Discussion of the Related Art

In general, a gas furnace is a heating device that is used to heat an indoor space. The gas furnace may include a burner to burn fuel and a valve to control the amount of fuel supplied to the burner. Conventionally, the supply and shut-off of fuel is controlled via an on-off controlled solenoid valve.

For example, FIG. 1 illustrates a fuel supply unit for a gas furnace having a conventional valve for adjusting the amount of fuel supplied to a burner. Referring to FIG. 1, the fuel supply unit 1 includes a fuel line 3, which supplies fuel toward a burner 2, and two solenoid valves 4-1 and 4-2 provided in the fuel line 3. The two solenoid valves 4-1 and 4-2 may include a first solenoid valve 4-1 and a second solenoid valve 4-2. In addition, the first solenoid valve 4-1 may be located in front of the second solenoid valve 4-2 in the direction in which fuel flows. When there is no signal from a controller (not illustrated), the first solenoid valve 4-1 remains in the initial closed state thereof, and the second solenoid valve 4-2 remains in the initial state thereof so as to open the fuel line 3 partway. At this time, no fuel is supplied to the burner 2.

The controller may control the on-off operation of the first solenoid valve 4-1 and the second solenoid valve 4-2 based on a signal from a thermostat (not illustrated) installed in the indoor space. For example, when a medium heating power signal is transmitted from the controller, the first solenoid valve 4-1 is completely opened and the second solenoid valve 4-2 remains in the initial state thereof so as to open the fuel line 3 partway. When a high heating power signal is transmitted from the controller, all of the first solenoid valve 4-1 and the second solenoid valve 4-2 are completely opened. Accordingly, the conventional gas furnace may control the heating power of the burner 2 to two magnitudes (i.e. high heating power and medium heating power) based on two signals transmitted from the thermostat and based on the control of the on-off operation of the two solenoid valves 4-1 and 4-2.

The conventional gas furnace suffers several disadvantages. For example, due to the use of at least two solenoid valves 4-1 and 4-2 for the control of at least two magnitudes of heating power, the conventional gas furnace requires additional space for the installation of a variable number of valves, and has a complicated fuel flow path of fuel. Furthermore, it is difficult to implement the linear control of heating power, which results in excessive manufacturing costs attributable to a complicated flow path for the supply of fuel. Additionally, the conventional gas furnace problematically increases the variation in temperature in the indoor space because it may set heating power to only one of two magnitudes based on two signals from the thermostat.

SUMMARY OF THE INVENTION

Accordingly, the present disclosure is directed to a gas furnace for indoor heating that substantially obviates one or more problems due to limitations and disadvantages of the related art.

One object of the present disclosure is to provide a gas furnace for indoor heating, which may adjust the heating power (heating intensity) of a burner to at least three different magnitudes using a single valve.

In addition, another object of the present disclosure is to provide a gas furnace for indoor heating, which may realize a compact configuration owing to the use of a single valve and may simplify the flow path of fuel toward a burner.

In addition, another object of the present invention is to provide a gas furnace for indoor heating, which may implement the linear control of heating power and may reduce manufacturing costs, attributable to the reduced number of valves and the simplified flow path of fuel.

In addition, a further object of the present invention is to provide a gas furnace for indoor heating, which may minimize variation in temperature in an indoor space by controlling heating power in three stages while using a thermostat that generates only two signals.

According to an embodiment of the disclosure, a furnace is provided with a burner, an exhaust flow path, a recovery flow path, a blower that suctions indoor air through the recovery flow path and discharges the indoor air from an indoor space, a supply flow path that guides the discharged indoor air back to the indoor space after the discharged indoor air undergoes a heat exchange process in the exhaust flow path, and a fuel supply unit including a fuel supply line, a fuel discharge line, and a valve provided between the fuel supply line and the fuel discharge line, wherein the valve comprises a step motor and a blocking member coupled to a rotating shaft of the step motor, the blocking member moving in a straight direction via by driving the step motor, and wherein an opening amount of the valve between the fuel supply line and the fuel discharge line is adjusted by the straight movement of the blocking member.

BRIEF DESCRIPTION OF THE DRAWINGS

The accompanying drawings, which are included to provide a further understanding of the present invention and are incorporated in and constitute a part of this application, illustrate embodiment(s) of the present disclosure and together with the description serve to explain the principle of the present disclosure. In the drawings:

FIG. 4(*a*) illustrates the state in which the flow path of fuel is completely closed by the valve, FIG. 4(*b*) illustrates the state in which the flow path of fuel is partially opened as the valve is linearly moved, and FIG. 4(*c*) illustrates the state in which the flow path of fuel is completely opened.

DETAILED DESCRIPTION OF THE INVENTION

Figure 1:
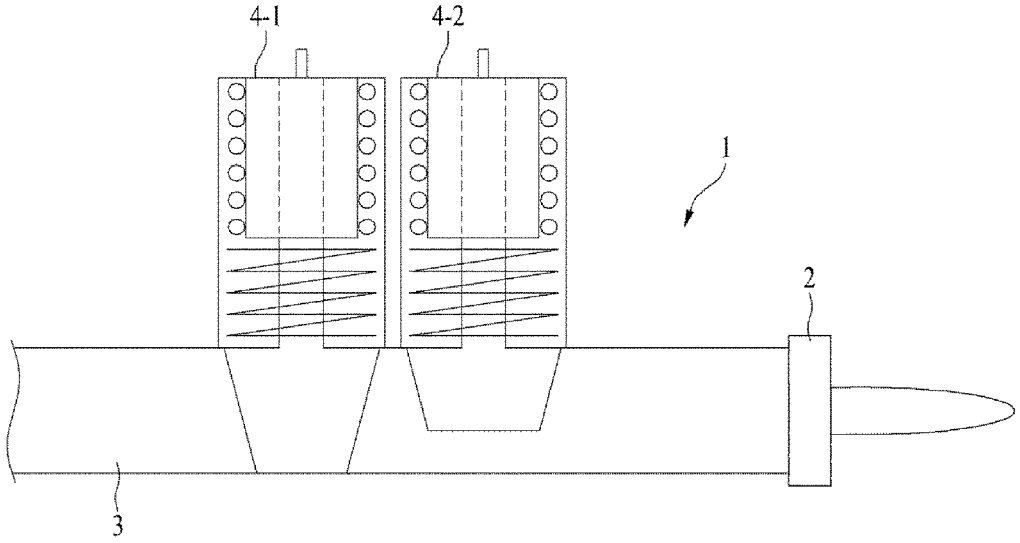
FIG. 1 PRIOR ART
FIG. 1 is a view schematically illustrating a conventional gas furnace having a valve configured to adjust the amount of fuel supplied to a burner.

Hereinafter, a gas furnace for indoor heating in accordance with embodiments of the present disclosure will be described in detail with reference to the accompanying drawings. The accompanying drawings illustrate the exemplary configuration of the present disclosure, and are merely provided for the detailed description of the present disclosure and the technical range of the present disclosure is not limited by the accompanying drawings.

In addition, in the drawings, the same or similar elements are denoted by the same reference numerals even though they are depicted in different drawings, and a repeated description thereof will be omitted.

Figure 2:
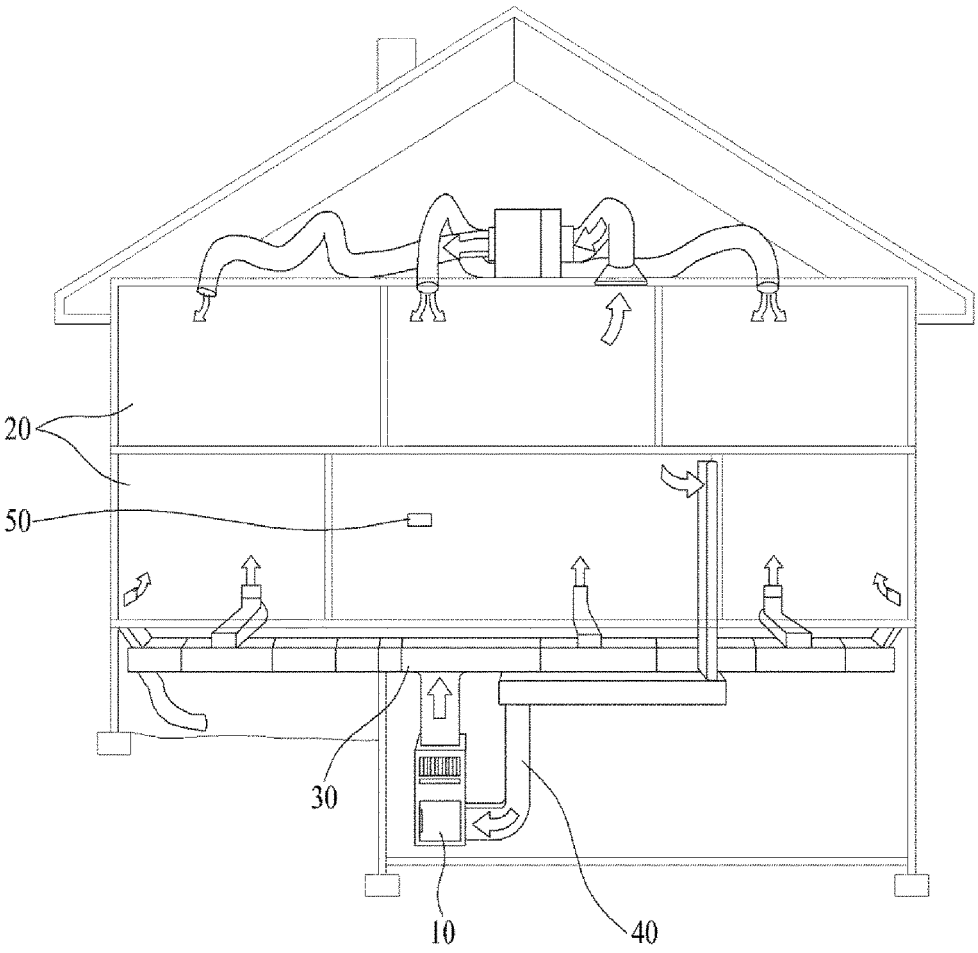
FIG. 2 is a schematic view illustrating a gas furnace for indoor heating in accordance with an embodiment of the present disclosure, which is used to heat an indoor space.

FIG. 2 is a schematic view illustrating a gas furnace for indoor heating in accordance with an embodiment of the present disclosure, which is used to heat an indoor space. Referring to FIG. 2, the gas furnace 10 for indoor heating may be configured to supply heated air into an indoor space via heat exchange between air and high-temperature exhaust gas that is generated by the burning of fuel. The fuel may be gas fuel or liquid fuel, but is not limited thereto.

For example, the gas furnace 10 may be configured to supply heated air into at least one indoor space 20 through a supply flow path 30. The supply flow path 30 may be a supply duct.

When there are a plurality of indoor spaces 20 to be heated, such as shown in FIG. 2, the supply flow path 30 may include a plurality of supply flow paths to supply heated air to the respective indoor spaces. Additionally, air inside the indoor space 20 may be recovered to the gas furnace for indoor heating 10 through a recovery flow path 40 which communicates with the indoor space 20.

In the indoor space 20, the supply flow path 30 and the recovery flow path 40 may be arranged at different positions. For example, the supply flow path 30 may be arranged on the sidewall of the indoor space 20, and the recovery flow path 40 may be arranged on the ceiling of the indoor space 20. In another example, the supply flow path 30 may be arranged on the ceiling of the indoor space 20 and the recovery flow path 40 may be arranged on the sidewall of the indoor space 20. In yet another example, the supply flow path 30 may be arranged on one sidewall of the indoor space 20 and the recovery flow path 40 may be arranged on another sidewall of the indoor space 20.

Additionally, at least one thermostat 50 may be installed in the indoor space 20. The thermostat 50 may take the form of a temperature adjustor. A temperature sensor (not shown) may be provided in the thermostat 50. The gas furnace 10 may be driven based on a signal from the thermostat 50.

Figure 3:
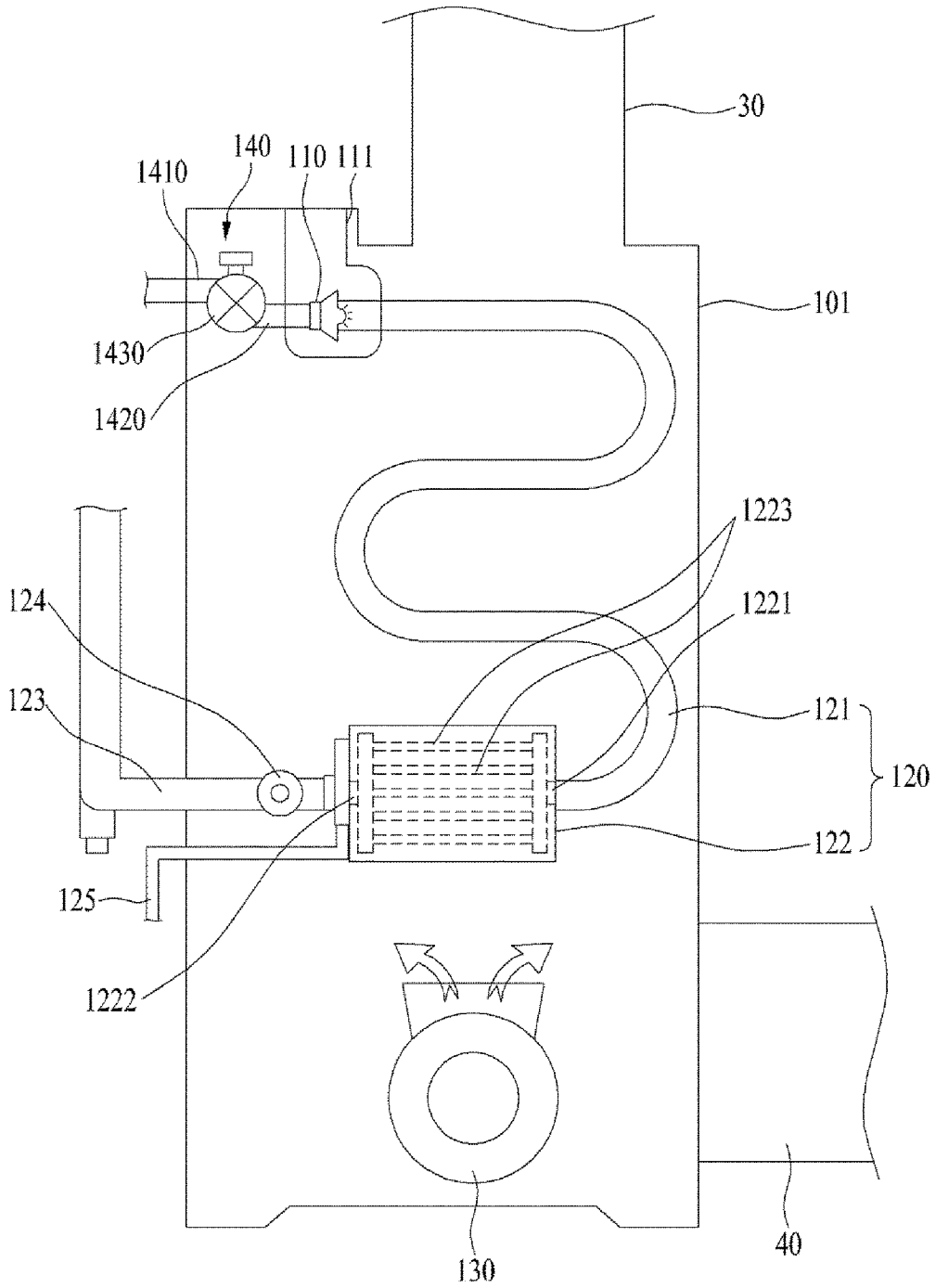
FIG. 3 is a view schematically illustrating the configuration of the gas furnace for indoor heating in accordance with an embodiment of the present disclosure.

FIG. 3 is a view illustrating the configuration of the gas furnace for indoor heating in accordance with an embodiment of the present disclosure. Referring to FIG. 3, the gas furnace 10 may include a burner 110 configured to burn fuel, an exhaust flow path 120 along which exhaust gas flows, a blower 130 configured to suction indoor air through the recovery flow path 40, the supply flow path 30 through which the indoor air, having exchanged heat with the exhaust flow path 120, is guided to an indoor space, and a fuel supply unit 140 configured to supply fuel to the burner 110.

The burner 110 may include an igniter to burn fuel, such as a spark plug. In addition, the burner 110 may produce high-temperature exhaust gas by burning the fuel supplied to the burner 110.

An air flow path 111 may be provided at one side of the burner 110 so as to supply outside air toward the burner 110. For example, the air flow path 111 may be provided at one side of a cabinet 101, which forms the external appearance of the gas furnace, at a position corresponding to the burner 110.

The fuel supplied to the burner 110 and the air supplied through the air flow path 111 may be factors for the generation of flame in the burner 110. The air flow path 111 may communicate with the exhaust flow path 120.

The exhaust flow path 120 may be configured to enable the flow of the high-temperature exhaust gas, generated by burning the fuel in the burner 110. The exhaust flow path 120 may be formed of a material having a high heat transfer coefficient for the exchange of heat with air to be supplied to the indoor space, but is not limited to any particular type of material.

According to a non-limiting embodiment of the invention, the exhaust flow path 120 may include a first heat exchange part 121 and a second heat exchange part 122. The first heat exchange part 121 may be attached to the discharge end of the burner 110 and may take the form of a heat exchange tube having a plurality of serpentine portions. The high-temperature exhaust gas, generated by the driving of the burner 110, may flow into the first heat exchange part 121. The second heat exchange part 122 may be provided at an end of the first heat exchange part 121. The second heat exchange part 122 may be formed to diverge the exhaust gas, guided from the first heat exchange part 121, into a plurality of fine flow paths 1223. Such configuration increases the surface area of the second heat exchange part 122 so as to increase heat exchange efficiency.

For example, the second heat exchange part 122 may include a single inlet 1221, into which the exhaust gas guided from the first heat exchange part 121 is introduced, the fine flow paths 1223 diverged from the inlet 1221, and an outlet 1222 in which the exhaust gas guided through the fine flow paths 1223 is merged.

The first heat exchange part 121 may be located at least partially above the second heat exchange part 122. In addition, the blower 130, which will be described later, may be located below the second heat exchange part 122. Accordingly, the air discharged from the blower 130 may undergo heat exchange with relatively low-temperature exhaust gas in the second heat exchange part 122, and may undergo heat exchange with relatively high-temperature exhaust gas in the first heat exchange part 121.

At this time, water vapor contained in the exhaust gas may be condensed due to a reduction in the temperature of the exhaust gas in the second heat exchange part 122. Therefore, in order to discharge water condensed from the exhaust gas outward, a condensed water flow path 125 may be connected to the discharge end of the second heat exchange part 122.

An exhaust pipe 123 may be provided on the rear end of the second heat exchange part 122, and a fan 124 may be provided in the exhaust pipe 123 to suction outside air through the above-described air flow path 111.

The blower 130 may be configured to suction indoor air through the recovery flow path 40. That is, the indoor air may be suctioned to the blower 130 inside the cabinet 101 through the recovery flow path 40. The blower 130 may also be configured to discharge the suctioned air. For example, the air, suctioned to the side surface of the cabinet 101 by the blower 130, may be discharged upward of the cabinet 101 by the blower 130.

The air discharged by the blower 130 may be guided to the indoor space through the supply flow path 30 after undergoing heat exchange in the exhaust flow path 120. That is, as the blower 130 is driven, the air in the indoor space may be suctioned into the cabinet 101 through the recovery flow path 140 and may then again be supplied to the indoor space through the supply flow path 30 after undergoing heat exchange in the exhaust flow path 120.

The fuel supply unit 140 may include a fuel supply line 1410, a fuel discharge line 1420, and a valve 1430 provided between the fuel supply line 1410 and the fuel discharge line 1420. The fuel supply line 1410 may be configured to guide fuel from an external fuel source (not illustrated) to the valve 1430. The fuel discharge line 1420 may be configured to guide the fuel to the burner 110. An amount, or degree, that the valve 1430 between the fuel supply line 1410 and the fuel discharge line 1420 is opened may be adjusted. Through the use of the valve 1430, the amount of fuel to be directed to the burner 110 may be linearly adjusted. That is, the heating power of the burner 110 may be linearly adjusted to various magnitudes by controlling the opening degree of the valve 1430. Thus, according to an embodiment of the disclosure, the gas furnace for indoor heating 10 may include a single valve 1430 for the supply of fuel, and the heating power of the burner 110 may be adjusted at least three magnitudes by adjusting or increasing the opening degree of the valve 1430.

Figure 4A:
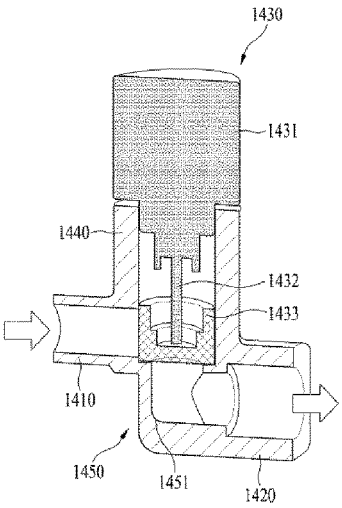
FIGS. 4(*a*), 4(*b*), and 4(*c*) are views illustrating the configuration of a valve provided in the gas furnace illustrated in FIG. 3.
Figure 4B:
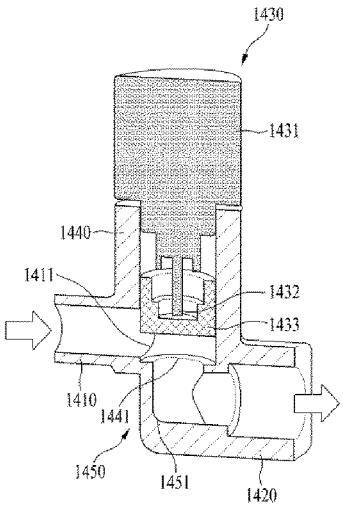
Figure 4C:
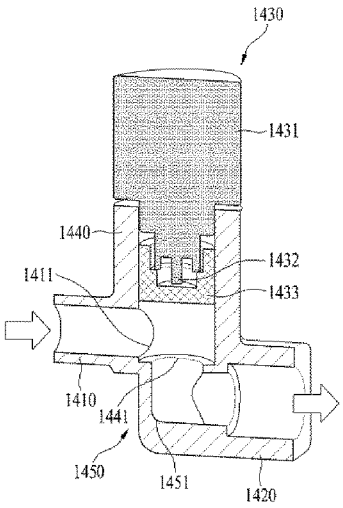

FIGS. 4(*a*)-4(*c*) are views illustrating the configuration of the valve provided in the gas furnace for indoor heating shown in FIG. 3. Specifically, FIG. 4(*a*) illustrates the state in which the flow path of fuel is completely closed by the valve, FIG. 4(*b*) illustrates the state in which the flow path of fuel is partially opened as the valve is linearly moved, and FIG. 4(*c*) illustrates the state in which the flow path of fuel is completely opened.

Referring to FIGS. 3 and 4(*a*)-4(*c*) together, as described above, the fuel supply unit 140 may include the fuel supply line 1410, the fuel discharge line 1420, and the valve 1430. The valve 1430 may include a step motor 1431 and a blocking member 1433. The blocking member 1433 may be coupled to a rotating shaft 1432 of the step motor 1431 so as to linearly move as the step motor 1431 is driven.

The distance by which the rotating shaft 1432 is moved may be determined based on the rotation angle of the step motor 1431. In addition, the movement direction of the rotating shaft 1432 may be determined based on the rotational direction of the motor 1431.

The blocking member 1433 may be configured so as to be coupled to the rotating shaft 1432 of the step motor 1431. As such, the blocking member 1433 may be provided so as to move in a straight direction along with the rotating shaft 1432 based on the driving of the step motor 1431. That is, the distance by which the blocking member 1433 moves in the straight direction may be determined based on the rotation angle of the step motor 1431.

The opening degree of the valve 1430 between the fuel supply line 1410 and the fuel discharge line 1420 may be adjusted via the straight movement of the blocking member 1433. Specifically, the blocking member 1433 may be configured so as to adjust the opening degree of a discharge end 1411 of the fuel supply line 1410.

The height of the blocking member 1433 may be greater than the diameter of the fuel supply line 1410. More specifically, the height of the blocking member 1433 may be greater than the diameter of the discharge end 1411. This enables the blocking member 1433, which moves in a vertically straight direction, to close the discharge end 1411 of the fuel supply line 1410 when the valve 1430 is in a completely closed state. Accordingly, by adjusting the opening degree by the blocking member 1433, the amount of fuel to be supplied to the burner 110 may be linearly controlled.

The fuel supply line 1410 and the fuel discharge line 1420 may be configured so as to extend in the same direction as each other. That is, the fuel supply line 1410 and the fuel discharge line 1420 may be arranged parallel to each other. Accordingly, when the fuel supplied through the fuel supply line 1410 is supplied to the fuel discharge line 1420 by way of the valve 1430, the flow direction of fuel in the fuel supply line 1410 and the flow direction of fuel in the fuel discharge line 1420 may be the same. Such configuration prevent a loss of pressure depending on variation in the flow direction of fuel while the fuel is supplied toward the burner 110.

The straight movement direction of the blocking member 1433 may be orthogonal with respect to the direction in which the fuel supply line 1410 and the fuel discharge line 1420 extend.

In the illustrated embodiment, the fuel supply line 1410 and the fuel discharge line 1420 may extend in a horizontal direction, and the blocking member 1433 may extend straight in a vertical direction between the fuel supply line 1410 and the fuel discharge line 1420. Accordingly, the amount of fuel flowing to the fuel discharge line 1420 through the fuel supply line 1410 may be linearly controlled by the step motor 1431 and the blocking member 1433.

The fuel supply unit 140 may further include a guide 1440 configured to guide the straight direction movement of the blocking member 1433 between the fuel supply line 1410 and the fuel discharge line 1420. The upper end of the guide 1440 and the lower end of the step motor 1431 may be sealed together to prevent leakage of fuel upward from the guide 1440.

The guide 1440 may have a cylindrical shape, and the blocking member 1433 may be formed into a cylinder. In addition, the diameter of the blocking member 1433 may be smaller than the diameter of the guide 1440. Accordingly, a gap may be present between the outer circumferential surface of the blocking member 1433 and the inner circumferential surface of the guide 1440. The blocking member 1433 may move straight in the vertical direction inside the guide 1440. It is understood that the guide 1440 and blocking member 1433 are not limited to any particular shape.

The guide 1440 may be provided on one side of the inner circumferential surface thereof with a seating portion 1441 so that the lower end of the blocking member 1433 is seated on the seating portion 1441. The seating portion 1441 may be provided on the inner circumferential surface of the lower end of the guide 1440. The seating portion 1441 may protrude radially inward of the guide 1440. In addition, the seating portion 1441 may extend in the peripheral direction of the inner circumferential surface of the blocking member 1433.

Accordingly, as illustrated in FIG. 4(*a*), the lower end of the blocking member 1433 may contact an upper surface of the seating portion 1441 (not shown) in the completely closed state of the valve 1430. At this time, the seating portion 1441 may be located below the lower end of the fuel supply line 1410. That is, the seating portion 1441 may be located lower than the discharge end 1411 of the fuel supply line 1410. Such configuration may prevent fuel from leaking to the fuel discharge line 1420 through the gap between the blocking member 1433 and the guide 1440 in the completely closed state of the valve 1430.

A stepped part 1450 may be provided between the fuel supply line 1410 and the fuel discharge line 1420. As shown in the illustrated embodiment, the stepped part 1450 may be stepped downward. For example, the stepped part 1450 may have an "L"-shape. Through the provision of the stepped part 1450, the fuel discharge line 1420 may be located lower than the fuel supply line 1410. The fuel supply line 1410 and the fuel discharge line 1420 may also extend parallel to each other. In other words, through the provision of the stepped part 1450, the fuel supply line 1410 may be located above the fuel discharge pipe 1420.

The fuel supplied to the fuel supply line 1410 may be sequentially supplied to the burner 110 by way of the stepped part 1450 and the fuel discharge line 1420. Because the fuel discharge line 1420 is provided below the fuel supply line 1410 due to the stepped part 1450, it is possible to prevent the fuel from leaking to the fuel discharge line 1420 through the gap between the blocking member 1433 and the guide 1440.

The distance by which the above-described seating portion 1441 protrudes inward of the guide 1440 may be greater than the width of the gap between the blocking member 1433 and the guide 1440. The stepped part 1450 may communicate with the guide 1440—as such, the fuel, which is supplied to the fuel supply line 1410 when the valve 1430 is opened, may be guided to the fuel discharge line 1420 by way of the stepped part 1450.

The stepped part 1450 may have at least one curved portion 1451. The curved portion 1451 may be provided at a corner area of the stepped part 1451. Such configuration serves to reduce the loss of pressure of the fuel which flows from the fuel supply line 1410 to the fuel discharge line.

Figure 5:
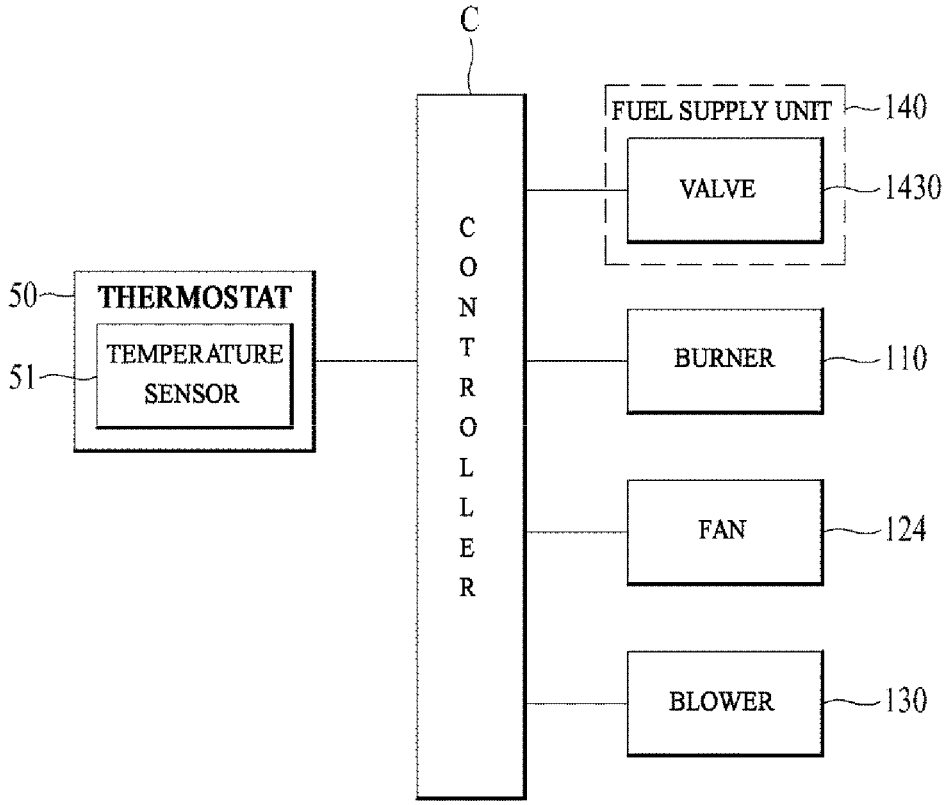
FIG. 5 is a block diagram illustrating the connection relationship between a controller provided in the gas furnace illustrated in FIG. 3 and components to be controlled by the controller.

FIG. 5 is a block diagram illustrating an embodiment of a connection relationship between a controller provided in the gas furnace for indoor heating illustrated in FIG. 3 and components to be controlled by the controller. Referring to FIG. 5, the gas furnace may include a controller C, which is configured to receive a signal from the thermostat 50 installed in the indoor space. The controller C may be provided in the thermostat 50, and may control the thermostat 50 so that the thermostat 50 selectively generates two signals (e.g., a high heating power signal and a medium heating power signal).

Although the thermostat 50 may be configured to generate only two signals including the high heating power signal and the medium heating power signal, the gas furnace may appropriately perform not only the control of high heating power and medium heating power of the burner 110, but also the control of lower heating power of the burner 110. Specifically, the controller C may control the fuel supply unit 140 based on a signal from the thermostat 50. The controller C may control the valve 1430 provided in the fuel supply unit 140 so that the opening degree of the valve 1430 is adjusted based on a signal from the thermostat 50.

The controller C may also control the driving of the burner 110, the fan 124, and the blower 130. The heating power of the burner 110 may be adjusted to a plurality of magnitudes based on the opening degree of the valve 1430. For example, the heating power of the burner 110 may be adjusted to at least three different magnitudes based on the opening degree of the valve 1430.

For convenience of description, the following description is made under the assumption that the heating power of the burner 110 may be adjusted to three different magnitudes (e.g. high heating power, medium heating power, and low heating power). That is, the following description is made under the assumption that the opening degree of the valve 1430 may be adjusted to three different magnitudes, not including the completely closed state of the valve 1430. The invention is not limited to only three different magnitudes.

The initial heating power of the burner 110 may be controlled based on a target temperature Ts set by the user. That is, the controller C may primarily control the heating power of the burner 110 based on the difference Ts−Ti between the preset target temperature Ts and an indoor temperature Ti, which is sensed by a temperature sensor 51 provided in the thermostat 50. Here, the heating power of the burner 110 may be controlled by adjusting the opening degree of the valve 1430.

In the primary control of the controller C, when the difference Ts−Ti is smaller than a preset value A, the controller C may adjust the opening degree of the valve 1430 so that the heating power of the burner 110 becomes a medium heating power during a first time period (e.g., relative to high and low heating powers).

That is, in the primary control of the controller C, when the difference Ts−Ti is smaller than the preset value A, high heating power of the burner 110 is not used. This is because, when high heating power is used in the state in which the difference between the target temperature Ts and the measured indoor temperature Ti is relatively small, the indoor temperature Ti may not remain near the target temperature Ts, but may increase significantly above the target temperature Ts and/or decrease significantly below the target temperature Ts.

On the other hand, in the primary control of the controller C, when the difference Ts−Ti is equal to or greater than the preset value A, the controller C may adjust the opening degree of the valve 1430 so that the heating power of the burner 110 becomes medium heating power during a second time period, and then becomes high heating power (relative to the medium heating power) during a third time period. Accordingly, in the primary control of the controller C, when the difference Ts−Ti is equal to or greater than the preset value A, high heating power of the burner 110 may be used.

The preset value A described above may be set to an optimal value in terms of fuel efficiency and heating efficiency through experimentation.

The first time period and the third time period may be longer than the second time period, and the third time period may be longer than the first time period. That is, the first time period may be longer than the second time period and the third time period, and the third time period may be longer than the second time period. For example, the first time period may be within a range from 110 seconds to 130 seconds, the second time period may be within a range from 20 seconds to 40 seconds, and the third time period may be within a range from 50 seconds to 70 seconds. More specifically, the first time may be 120 seconds, the second time may be 30 seconds, and the third time may be 60 seconds.

Following the primary control, the controller C may secondarily control the heating power of the burner 110 based on whether the indoor temperature Ti has reached the target temperature Ts. That is, the controller C may again receive the indoor temperature Ti from the indoor thermostat 50 after the primary control.

In the secondary control, the opening degree of the valve 1430 may be adjusted by the controller C so that the heating power of the burner 110 becomes at least one of low heating power and medium heating power. That is, high heating power of the burner 110 is not used in the secondary control.

This is because there is a high possibility that the indoor temperature Ti has approximately reached the target temperature Ts via the primary control described above, and at this time, the indoor temperature Ti greatly exceeds the target temperature Ts and variation in the difference between the target temperature Ts and the indoor temperature Ti increases when the heating power of the burner 110 is controlled to high heating power.

For example, in the secondary control after the primary control of the controller C, when the difference Ts−Ti is below the preset value A, the opening degree of the valve 1430 may be adjusted so that the heating power of the burner 110 becomes a low heating power during the third time period. Such operation prevents the indoor temperature Ti from significantly exceeding the target temperature Ts by controlling the heating power of the burner 110 to the low heating power because there is a high possibility that the indoor temperature Ti has approached the target temperature Ts via the primary control.

On the other hand, in the secondary control, when the difference Ts−Ti is equal to or greater than the preset value A, the valve 1430 may be controlled by the controller C so as to be completely closed.

Meanwhile, in the secondary control, when the indoor temperature Ti is below the target temperature Ts even after the opening degree of the valve 1430 is adjusted so that the heating power of the burner 110 becomes a low heating power, the controller C may adjust the opening degree of the valve 1430 so that the heating power of the burner 110 becomes a medium heating power during the second time period.

In particular, in the secondary control, the controller C may adjust the opening degree of the valve 1430 so that the low heating power control of the burner 110 and the medium heating power control of the burner 110, which are described above, are repeated until the indoor temperature Ti becomes greater than or equal to the target temperature Ts.

That is, in the secondary control, the controller C may repeat adjustment of the opening degree of the valve 1430 so that the heating power of the burner 110 becomes a low heating power and a medium heating power in sequence until the indoor temperature Ti becomes greater than or equal to the target temperature Ts. This minimizes the difference between the indoor temperature Ti and the target temperature Ts via the repetitive control of low heating power and medium heating power of the burner 110.

As described above, the gas furnace for indoor heating in accordance with the embodiment of the present invention may control the heating power of the burner 110 to at least three different magnitudes through the use of the thermostat 50, which generates only two signals, and the valve 1430, the opening degree of which may be adjusted to various different magnitudes, and owing to the control of the heating power of the burner 110 to at least three different magnitudes, may minimize variation in the temperature of the indoor space.

Figure 6:
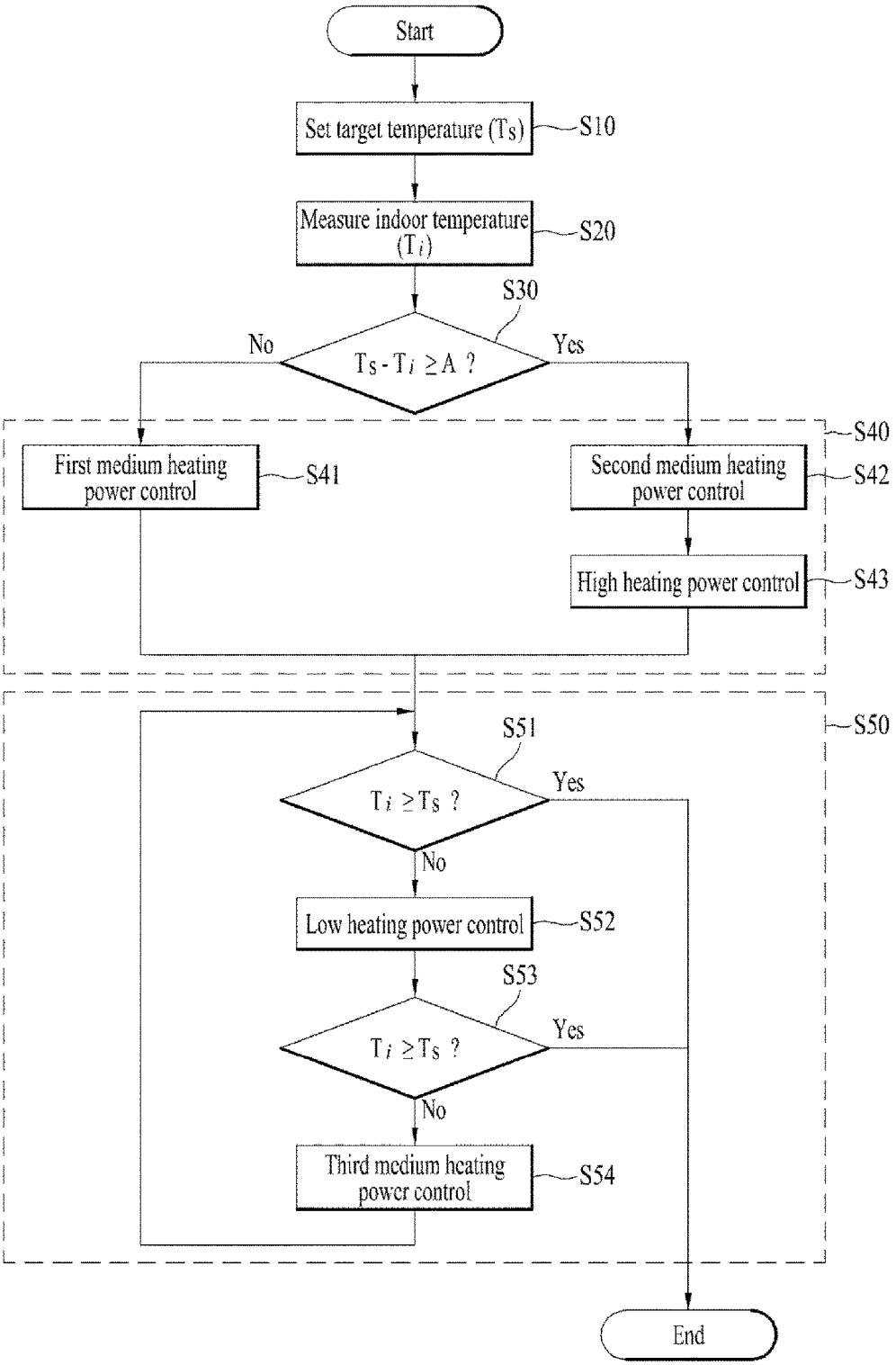
FIG. 6 is a flowchart illustrating a control method of the gas furnace for indoor heating in accordance with an embodiment of the present disclosure.

FIG. 6 is a flowchart illustrating a control method of the gas furnace for indoor heating in accordance with an embodiment of the present disclosure. It is understood that the configuration of the gas furnace for indoor heating described with reference to FIGS. 2 through 5 may be equally applied to the control method illustrated in FIG. 6.

Referring to FIG. 6, the control method includes a temperature setting operation S10 of setting a target temperature Ts via the thermostat 50, a temperature measuring operation S20 of measuring an indoor temperature Ti using a temperature sensor 51 provided in the thermostat 50, a primary valve control operation S40 of adjusting the opening degree of the valve 1430 so that the heating power of the burner 110 becomes at least one of the medium heating power and a high heating power based on the difference Ts−Ti between the target temperature Ts and the indoor temperature Ti, and a secondary valve control operation S50 of adjusting the opening degree of the valve 1430 so that the heating power of the burner 110 becomes at least one of a low heating power and the medium heating power based on whether the indoor temperature Ti has reached the target temperature Ts.

In the temperature setting operation S10, the user may set the target temperature Ts via the thermostat 50. The thermostat 50 may include an input unit (not illustrated) through which the target temperature Ts may be input by the user.

In the temperature measuring operation S20, the indoor temperature Ti may be measured using the temperature sensor 51 provided in the thermostat 50. The temperature sensor 51 may measure the indoor temperature Ti in real time, and the measured indoor temperature Ti may be transmitted to the controller C via the thermostat 50.

Before the primary valve control operation S40, the difference between the target temperature Ts and the indoor temperature Ti may be calculated, and the difference Ts−Ti may be compared with a preset value A (S30).

In the primary valve control operation S40, the opening degree of the valve 1430 may be adjusted so that the heating power of the burner 110 becomes at least one of medium heating power and high heating power based on the result of comparing the difference between the target temperature Ts and the indoor temperature Ti with the preset value A.

When the difference Ts−Ti is less than the preset value A, the primary valve control operation S40 may include a first medium heating power control operation S41 of adjusting the opening degree of the valve 1430 so that the heating power of the burner 110 becomes medium heating power during a first time period.

In the first medium heating power control operation S41, the opening degree of the valve 1430 may be adjusted so that the heating power of the burner 110 is maintained at medium heating power during the first time period. That is, when the difference Ts−Ti is less than the preset value A, the primary valve control operation S40 may include only the first medium heating power control operation S41.

In addition, when the difference Ts−Ti is equal to or greater than the preset value A, the primary valve control operation S40 may include a second medium heating power control operation S42 of adjusting the opening degree of the valve 1430 so that the heating power of the burner 110 becomes medium heating power during a second time period, and a high heating power control operation S43 of adjusting the opening degree of the valve 1430 so that the heating power of the burner 110 becomes high heating power during a third time period after the second medium heating power control operation S42.

In the second medium heating power control operation S42, the heating power of the burner 110 may be maintained at medium heating power during the second time period. Then, the control method proceeds to the high heating power control operation S43. In the high heating power control operation S43, the heating power of the burner 110 may be maintained at high heating power during the third time period. That is, when the difference Ts−Ti is equal to or greater than the preset value A, the primary valve control operation S40 may include only the second medium heating power control operation S42 and the high heating power control operation S43.

Thus, through the foregoing primary valve control operation S40, the indoor temperature Ti may more rapidly approach the target temperature Ts.

After the primary valve control operation S40, the controller C may receive the indoor temperature Ti from the thermostat 50 in real time. That is, the controller C may receive the indoor temperature Ti from the thermostat 50 in real time, immediately after the primary valve control operation S40 ends.

Accordingly, the secondary valve control operation S50 subsequent to the primary valve control operation S40 may include a first judgment operation S51 of judging whether the indoor temperature Ti has reached at least the target temperature Ts, and a low heating power control operation S52 of controlling the heating power of the burner 110 to low heating power based on the judged result in the first judgment operation S51.

In the first judgment operation S51, the controller C may judge whether the indoor temperature Ti, measured after the primary valve control operation S40, has reached at least the target temperature Ts. In other words, the indoor temperature Ti, measured by the temperature sensor 51 before the first judgment operation S51, may be transmitted to the controller C via the thermostat 50.

At this time, upon judging in the first judgment operation S51 that the indoor temperature Ti is below the target temperature Ts, in the low heating power control operation S52, the opening degree of the valve 1430 may be adjusted so that the heating power of the burner 110 becomes low heating power during the third time period. Also, upon judging in the first judgment operation S51 that the indoor temperature Ti has reached at least the target temperature Ts, the valve 1430 may be completely closed by the controller C, and warm air using the latent heat of the exhaust flow path may be supplied to the indoor space as the blower is additionally driven.

After the low heating power control operation S52, the secondary valve control operation S50 may further include a second judgment operation S53 of judging whether the indoor temperature Ti has reached at least the target temperature, and a third medium heating power control operation S54 of controlling the heating power of the burner 110 to medium heating power based on the judged result of the second judgment operation S53.

In the second judgment operation S53, the controller C may judge whether the indoor temperature Ti, measured after the low heating power control operation S52, has reached at least the target temperature Ts. That is, the controller C may receive the indoor temperature Ti from the thermostat 50 in real time between the low heating power control operation S52 and the second judgment operation S53. In other words, the indoor temperature Ti, measured by the temperature sensor 51 before the second judgment operation S53, may be transmitted to the controller C via the thermostat 50.

At this time, upon judging in the second judgment operation S53 that the indoor temperature Ti is below the target temperature Ts, in the third medium heating power control operation S54, the opening degree of the valve 1430 may be adjusted so that the heating power of the burner 110 becomes medium heating power during the second time period. Upon judging in the second judgment operation S53 that the indoor temperature Ti is equal to or greater than the target temperature Ts, the valve 1430 may be completely closed by the controller C, and warm air using the latent heat of the exhaust flow path may be supplied to the indoor space as the blower is additionally driven.

The low heating power control operation S52 and the third medium heating power control operation S54 included in the secondary valve control operation S50 may be repeatedly performed until the indoor temperature Ti becomes at least the target temperature Ts. Specifically, the indoor temperature Ti may be transmitted to the controller C in real time through the thermostat 50, and the controller C may judge, via the first judgment operation S51 and the second judgment operation S53, whether the indoor temperature Ti has reached the target temperature Ts. The low heating power control operation S52 and the third medium heating power control operation S54 may be sequentially repeated until it is judged in the first judgment operation S51 or the second judgment operation S52 that the indoor temperature Ts is equal to or greater than the target temperature Ts.

Through the sequential and repetitive implementation of the low heating power control operation S51 and the third medium heating power control operation S54, variation in the difference between the indoor temperature Ti and the target temperature Ts may be minimized.

As is apparent from the above description, according to the present disclosure, a gas furnace for indoor heating may be provided that adjusts the heating power (heating intensity) of a burner to at least three different magnitudes using a single valve. Additionally, the gas furnace may have a compact configuration using a single valve and a simplified flow path of fuel toward a burner. Additionally, the gas furnace may implement a linear control of heating power and may reduce manufacturing costs, attributable to the reduced number of valves and the simplified flow path of fuel. Additionally, the gas furnace may minimize variation in temperature in an indoor space by controlling heating power in three stages while using a thermostat that generates only two signals.

Although the exemplary embodiments of the disclosure have been illustrated and described as above, it will be apparent to those skilled in the art that the embodiments are provided to assist understanding of the present disclosure and the invention is not limited to the above described particular embodiments, and various modifications and variations can be made in the present disclosure without departing from the spirit or scope of the invention, and the modifications and variations should not be understood individually from the viewpoint or scope of the present disclosure.

What is claimed is:

1. A furnace comprising:
- a burner;
- an exhaust flow path;
- a recovery flow path;
- a blower that suctions indoor air from an indoor space through the recovery flow path and discharges the indoor air;
- a supply flow path that guides the discharged indoor air back to the indoor space after the discharged indoor air undergoes heat exchange in the exhaust flow path; and
- a fuel supply unit including a fuel supply line, a fuel discharge line, and a valve provided between the fuel supply line and the fuel discharge line, wherein the valve comprises a step motor and a blocking member coupled to a rotating shaft of the step motor, the blocking member moving in a straight direction via by driving the step motor, wherein an opening amount of the valve between the fuel supply line and the fuel discharge line is adjusted by the straight movement of the blocking member so that the heating power of the burner is linearly adjusted to various magnitudes, wherein the fuel supply unit further includes a guide that guides the straight movement of the blocking member between the fuel supply line and the fuel discharge line, and wherein the guide comprises a seat portion that is provided at one side of an inner circumferential surface thereof, whereby the seat portion protrudes inward of the guide so that a lower end of the blocking member contacts the seat portion.

2. The furnace of claim 1, wherein the fuel supply line and the fuel discharge line extend in the same direction.

3. The gas furnace according to claim 2, wherein the fuel supply line and the fuel discharge line are substantially parallel to each other.

4. The furnace of claim 2, wherein a direction in which the blocking member moves straight is orthogonal to the direction in which the fuel supply line and the fuel discharge line extend.

5. The furnace of claim 1, wherein the seat portion extends in a peripheral direction of the inner circumferential surface of the guide.

6. The furnace of claim 5, wherein the seat portion is provided below a lower end of the fuel supply line.

7. The gas furnace of claim 1, wherein a stepped part is provided between the fuel supply line and the fuel discharge line.

8. The furnace of claim 7, wherein the stepped part is operative with the guide.

9. The furnace of claim 7, wherein the stepped part includes a curved portion to reduce a loss of pressure of the fuel flowing from the fuel supply line to the fuel discharge line.

10. The furnace of claim 7, wherein the stepped part has a substantially "L"-shape, whereby at least a portion of the fuel discharge line is provided below than the fuel supply line.

11. The gas furnace of claim 7, wherein the fuel supply line and the fuel discharge line extend substantially parallel to each other.

12. The furnace of claim 1, wherein a diameter of the fuel supply line is less than a diameter of the fuel discharge line.

13. The furnace of claim 1, wherein the blocking member adjusts an opening amount of a discharge end of the fuel supply line.

14. The furnace of claim 13, wherein a height of the blocking member is greater than a diameter of the fuel supply line.

15. The furnace of claim 1, wherein the exhaust flow path includes a first heat exchange part, and a second heat exchange part connected to a rear end of the first heat exchange part, wherein the first heat exchange part is connected to a discharge end of the burner and forms a heat exchange tube having a plurality of serpentine portions, and wherein the second heat exchange part diverges the exhaust gas guided from the first heat exchange part to a plurality of small flow paths.

16. The furnace of claim 15, further comprising:

an air flow path at one side of the burner that supplies outside air toward the burner, the air flow path communicating with the exhaust flow path, and a fan provided at a rear end of the second heat exchange part that supplies the outside air to the burner through the air flow path.

17. The furnace of claim 1, further comprising:

a controller that rotates the step motor based on a signal transmitted from a thermostat installed in the indoor space, wherein a distance of the straight movement of the blocking member is based on a rotation angle of the step motor.

* * * * *